US012357110B2

(12) United States Patent
Liu

(10) Patent No.: US 12,357,110 B2
(45) **Date of Patent: *Jul. 15, 2025**

(54) ROCKING CHAIR FOR CHILDREN

(71) Applicant: ZHONGSHAN CITY TONGYIN BABY CO., LTD., Guangdong (CN)

(72) Inventor: Weibing Liu, Guangdong (CN)

(73) Assignee: ZHONGSHAN CITY TONGYIN BABY CO., LTD., Zhongshan (CN)

( * ) Notice: Subject to any disclaimer, the term of this patent is extended or adjusted under 35 U.S.C. 154(b) by 122 days.

This patent is subject to a terminal disclaimer.

(21) Appl. No.: 18/113,619

(22) Filed: Feb. 23, 2023

(65) Prior Publication Data

US 2023/0190011 A1 Jun. 22, 2023

Related U.S. Application Data

(63) Continuation of application No. PCT/CN2020/126928, filed on Nov. 6, 2020.

(30) Foreign Application Priority Data

Aug. 27, 2020 (CN) ..... 202010880515.0

(51) Int. Cl.
*A47D 13/10* (2006.01)
*A47C 3/025* (2006.01)
*A47D 9/02* (2006.01)

(52) U.S. Cl.
CPC ..... *A47D 13/105* (2013.01); *A47C 3/0251* (2018.08); *A47D 9/057* (2022.08)

(58) Field of Classification Search
CPC ..... A47C 3/0251; A47D 13/105; A47D 9/057
USPC ..... 297/273
See application file for complete search history.

(56) References Cited

U.S. PATENT DOCUMENTS 7,669,927 B1 * 3/2010 Zaid ..... A47D 9/057 297/260.2
7,686,390 B2 * 3/2010 Dennis ..... A47C 15/004 297/217.3
10,376,061 B1 * 8/2019 Liu ..... A47C 3/0255
11,957,253 B2 * 4/2024 Liu ..... A47D 9/057
(Continued)

FOREIGN PATENT DOCUMENTS

CN 111134487 A * 5/2020 ..... A47C 3/0251

OTHER PUBLICATIONS

International Search Report of PCT Patent Application No. PCT/CN2020/126928 issued on May 27, 2021.

*Primary Examiner* — Jose V Chen

(57) ABSTRACT

A rocking chair for children includes a seat, a supporting frame, and a seat restricting mechanism, the supporting frame includes a base and a driving mechanism, and the driving mechanism includes a driving motor, a power-output part of the driving motor, a rotating shaft, and a mounting box; the seat restricting mechanism enabling an angle between the seat and the rotating shaft to be maintained at a preset angle, when the driving motor drives the rotating shaft to rotate reciprocatively. The purpose of the present invention is to provide a rocking chair for children, the seat being able to swing and not rotating relative to the rotating shaft, the swinging amplitude of the seat being greater, a plurality of swinging amplitude being able to be selected, and the rocking chair being at a low cost.

10 Claims, 6 Drawing Sheets

(56) References Cited

U.S. PATENT DOCUMENTS

| | | | | |
|---|---|---|---|---|
| 12,144,437 | B2 * | 11/2024 | Liu | A47D 13/105 |
| 2013/0229040 | A1 * | 9/2013 | Mountz | A47D 13/10 297/260.1 |
| 2014/0265490 | A1 * | 9/2014 | Hopke | A47D 13/10 297/260.2 |
| 2014/0287846 | A1 * | 9/2014 | Mountz | A47D 13/105 472/118 |
| 2015/0196137 | A1 * | 7/2015 | Zhao | A47D 1/00 297/260.1 |
| 2015/0265068 | A1 * | 9/2015 | Ferraro | A47D 9/02 472/118 |
| 2016/0058201 | A1 * | 3/2016 | Pavkov | A47D 13/107 297/440.22 |
| 2017/0065101 | A1 * | 3/2017 | Tadipatri | A47D 1/10 |
| 2017/0280891 | A1 * | 10/2017 | Mountz | A47D 1/10 |
| 2017/0367493 | A1 * | 12/2017 | Mountz | A47D 13/105 |
| 2019/0298064 | A1 * | 10/2019 | Shih | A47C 3/0255 |
| 2020/0129870 | A1 * | 4/2020 | Zou | A47C 3/0255 |
| 2021/0100368 | A1 * | 4/2021 | Juchniewicz | A47D 9/057 |
| 2022/0225789 | A1 * | 7/2022 | Liu | A47C 3/0251 |
| 2023/0124305 | A1 * | 4/2023 | Li | A47D 9/057 297/273 |
| 2023/0346135 | A1 * | 11/2023 | Mountz | A47D 1/10 |
| 2024/0245229 | A1 * | 7/2024 | Juchniewicz | A47D 9/057 |

* cited by examiner

ROCKING CHAIR FOR CHILDREN

CROSS REFERENCE TO RELATED APPLICATIONS

The present application is a Continuation Application of PCT Application No. PCT/CN2020/126928 filed on Nov. 6, 2020, which claims the benefit of Chinese Patent Application No. 202010880515.0 filed on Aug. 27, 2020. All the above are hereby incorporated by reference in their entirety.

FIELD OF THE INVENTION

The present invention relates to a rocking chair for children.

BACKGROUND OF THE INVENTION

For families with infants and toddlers, parents have to take care of young babies, but also need to work or do housework. It has become a great demand to swing children on the rocking chair. There are rocking chairs on the market with a seat fixedly connected to the rotating shaft, the seat rotating relative to the rotating shaft, but such rocking chairs are prone to make children dizzy and uncomfortable. There is also another rocking chair on the market, comprising two Z-shaped rotating shafts, the seat being movably connected to the two rotating shafts. Although the rotation angle of the seat relative to the rotating shaft is reduced, there exists still rotation of the seat relative to the rotating shaft. Problems with the chairs on the current market, such as not effort-saving or difficulty to increase the rotation range, still exist, which is difficult to meet the demand of consumers. Nowadays, the market needs a rocking chair for children, wherein the seat does not rotate relative to the rotating shaft, a plurality of swinging amplitude may be selected, and the rocking chair is at a low cost.

SUMMARY OF INVENTION

The present invention is proposed in view of the above-mentioned problems of the prior art. The purpose of the present invention is to provide a rocking chair for children, the seat is able to swing and does not rotate relative to the rotating shaft, the swinging amplitude of the seat is greater, a plurality of swinging amplitude may be selected, and the chair is at a low cost.

The present invention is implemented by the following technical solutions:

A rocking chair for children comprises a seat, a supporting frame and a seat restricting mechanism, the supporting frame comprising a base and a driving mechanism, the driving mechanism comprising a driving motor, a power-output part of the driving motor, a rotating shaft and a mounting box; wherein an end of the rotating shaft is fixedly connected to the power-output part of the driving motor, an opposite end of the rotating shaft is pivoted with the seat; and a pivoting point of the opposite end of the rotating shaft and the seat moves at a certain distance relative to a fixed point of the end of the rotating shaft and the power-output part of the driving motor when the rotating shaft rotates; the driving motor and the power-output part of the driving motor being provided on the mounting box, the mounting box being fixedly connected to the base, the seat restricting mechanism enabling an angle between the seat and the rotating shaft to be maintained at a preset angle, when the driving motor drives the rotating shaft to rotate; and the seat being used to carry a child, the seat restricting mechanism comprising a moving part and a moving slot matching the moving part, the moving part moving relative to the moving slot, when the rotating shaft rotates.

Further, the moving part is provided on the supporting frame or the seat, and the moving slot matching with the moving part is provided on the seat or the supporting frame.

Further, the moving slot is an arc-shaped slot with a lower level in middle and higher levels on both sides or a wave-shaped slot with alternating high and low levels.

Further, a rotating part is provided on the moving part, being able to rotate around the moving part, matching with a surface of the moving slot.

Further, the driving mechanism further comprises a sensor provided on the driving motor and a reduction gearset connected to the driving motor, and the sensor may control a continuous reciprocating forward and backward rotation of the driving motor, thereby enabling a continuous reciprocating forward and backward rotation of the rotating shaft, the rotating shaft being Z-shaped.

Further, the mounting box comprises a driver mounting box, used for mounting a driving motor, a power-output part of the driving motor, and a rotating shaft; the driver mounting box is provided on the base, the moving slot being provided on the seat away from the driver mounting box, and the moving part being provided on the base away from the driver mounting box.

Further, the mounting box further comprises a moving-part mounting box, and a seat locking-and-unlocking part, used for locking or unlocking the seat and the supporting frame, comprising a locking pin; a sliding block; a locking hole matching with the locking pin; a driver switch, movably provided relative to the moving-part mounting box, the locking pin being movably provided relative to the moving-part mounting box, the sliding block being connected to the driver switch, the locking hole being provided on the moving slot; and a reset spring.

Further, the seat restricting mechanism comprises a swing mode switching part, comprising the moving slot and the moving part, the moving slot being pivotally provided with the supporting frame; and a moving-slot locking-and-unlocking device, enabling the moving slot to be in a locked position and an unlocked position, the moving slot being locked relative to the supporting frame when the moving slot is in the locked position, the moving slot being rotatable relative to the supporting frame when the moving slot is in the unlocked position.

Further, the mounting box comprises a moving-slot mounting box, the moving slot being pivotally connected to the moving-slot mounting box, the moving-slot mounting box being fixedly connected to the supporting frame; the moving-slot locking-and-unlocking device comprising a conversion switch; a lift-down part; the conversion switch extending into the moving-slot mounting box to be fixedly connected to the lift-down part, a moving-guiding slot being provided on the moving slot for the lift-down part to be lifted or lowered; a reset spring, a hole for mounting the reset spring being provided on the lift-down part, the reset spring being provided between the mounting box and the lift-down part; a moving-part locking pin, provided on the conversion switch; and at least a first locking hole and a second locking hole, provided on the mounting box.

Further, the base comprises a first connecting tube, a second connecting tube, a first leg tube, and a second leg tube; the first leg tube and the second leg tube are detachably connected to the first connecting tube and the second connecting tube respectively, the driver mounting box comprising a driver mounting part fixedly connected to the first connecting tube and the second connecting tube.

BRIEF DESCRIPTION OF THE DRAWINGS

In order to illustrate the technical solutions of the embodiments of the present invention more clearly, a brief description is presented below in conjunction with the attached drawings. It is clear that the attached drawings in the following description are only specific embodiments of the present invention, and other drawings may be obtained based on these drawings without any inventive effort by those of ordinary skill in the art.

DETAILED DESCRIPTION OF THE PREFERRED EMBODIMENTS

Figure 1:
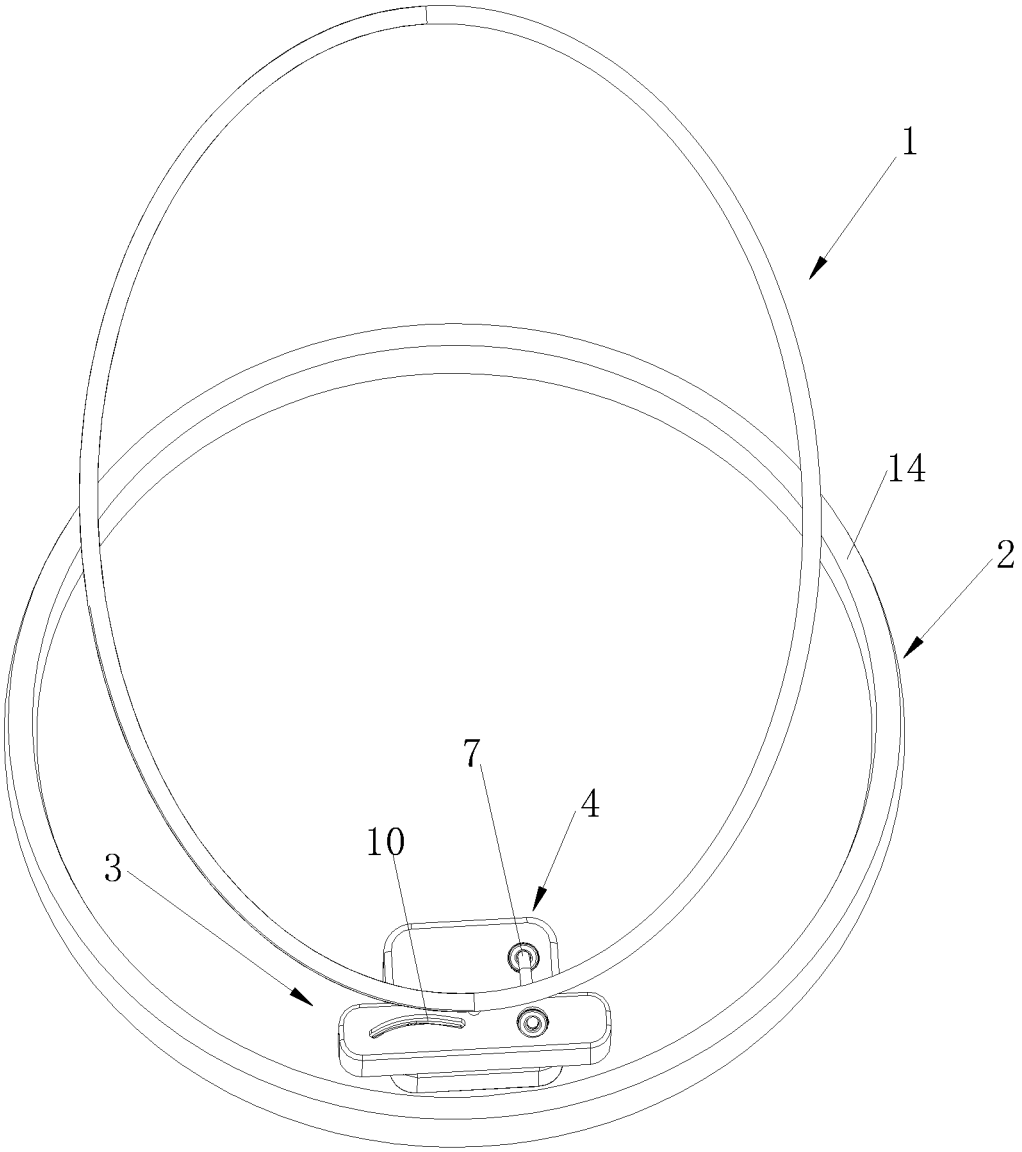
FIG. 1 is a structural diagram of a rocking chair for children.
Figure 2:
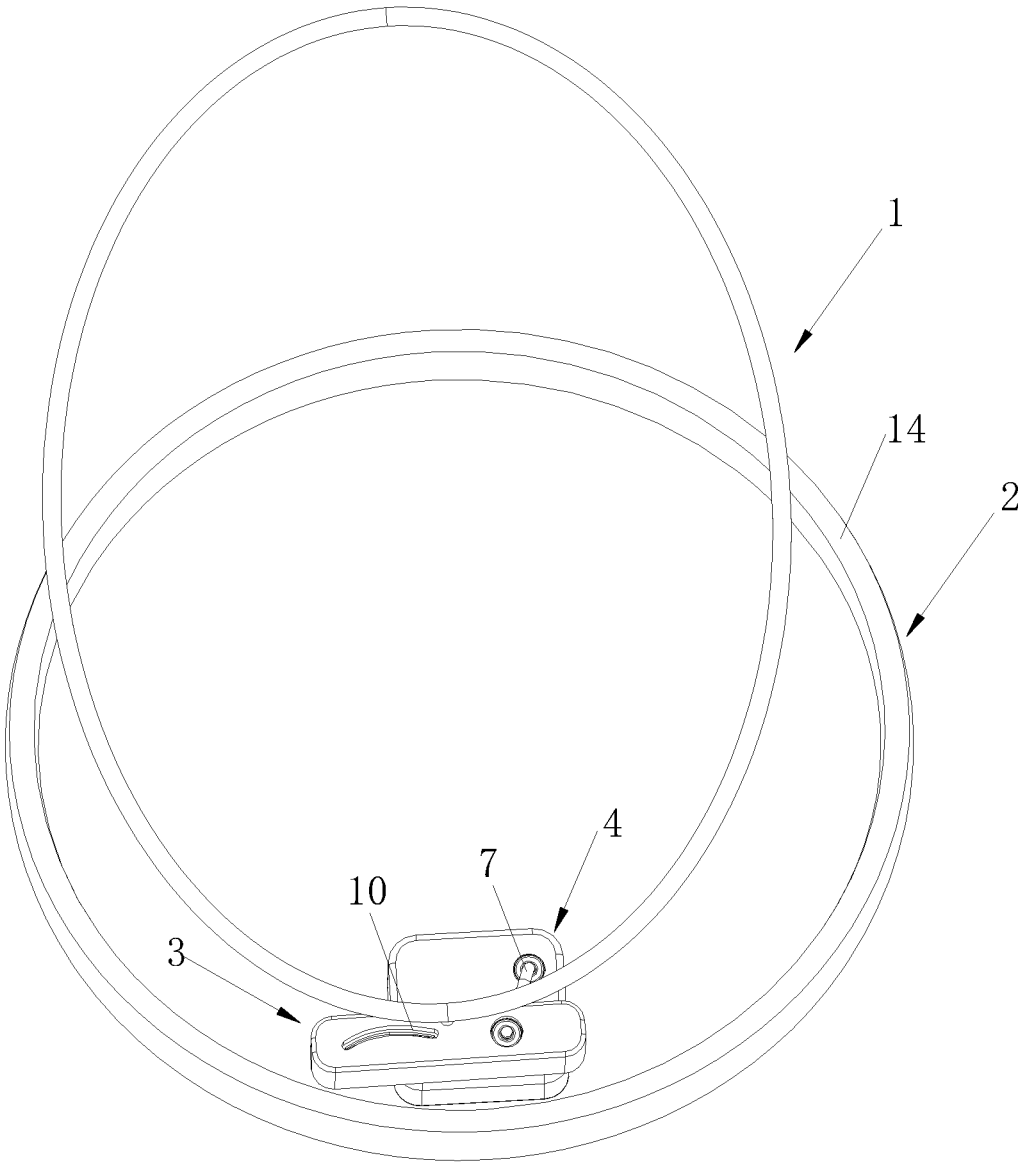
FIG. 2 is a structural diagram of a rocking chair for children after turning the rotating shaft to the left.
Figure 3:
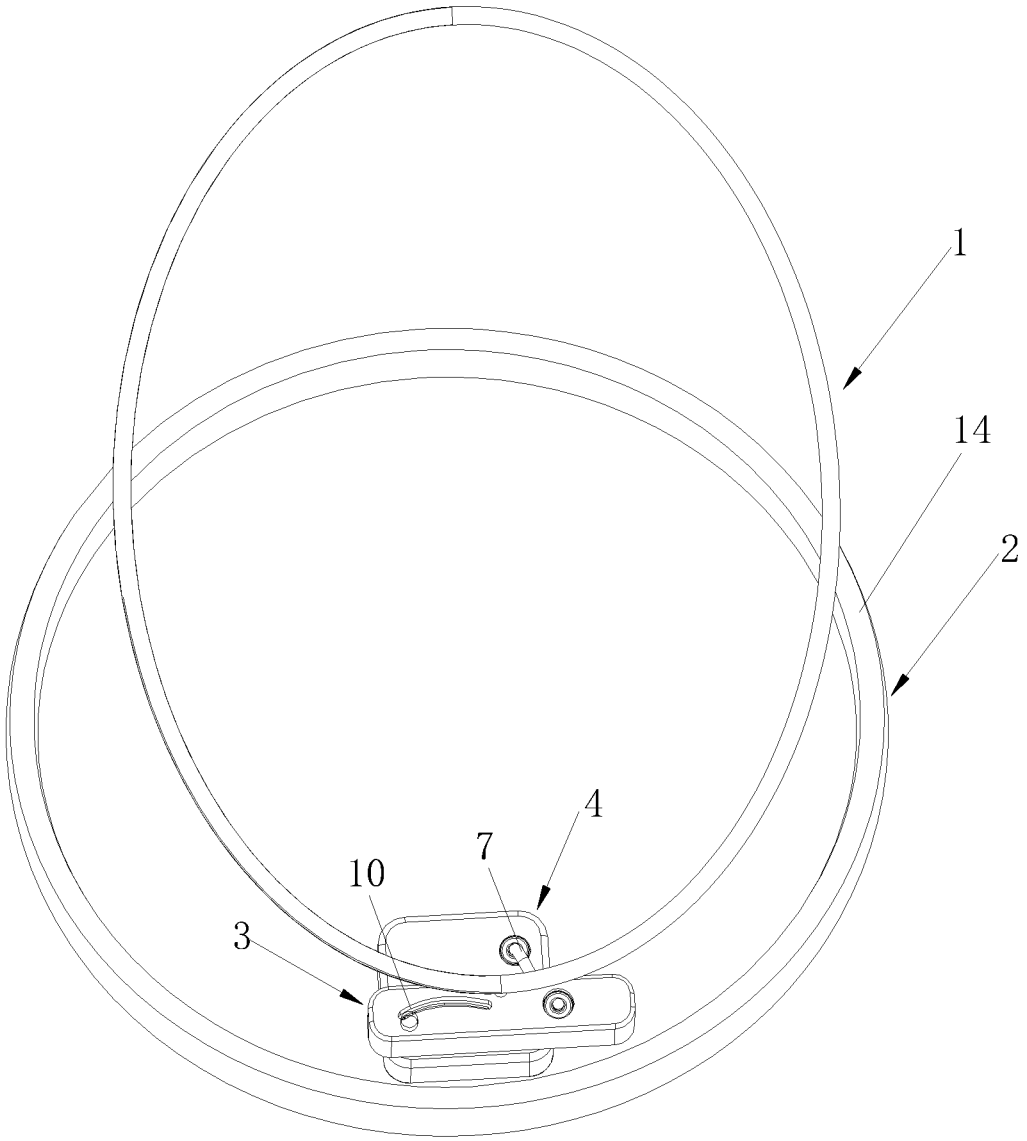
FIG. 3 is a structural diagram of a rocking chair for children after turning the rotating shaft to the right.
Figure 4:
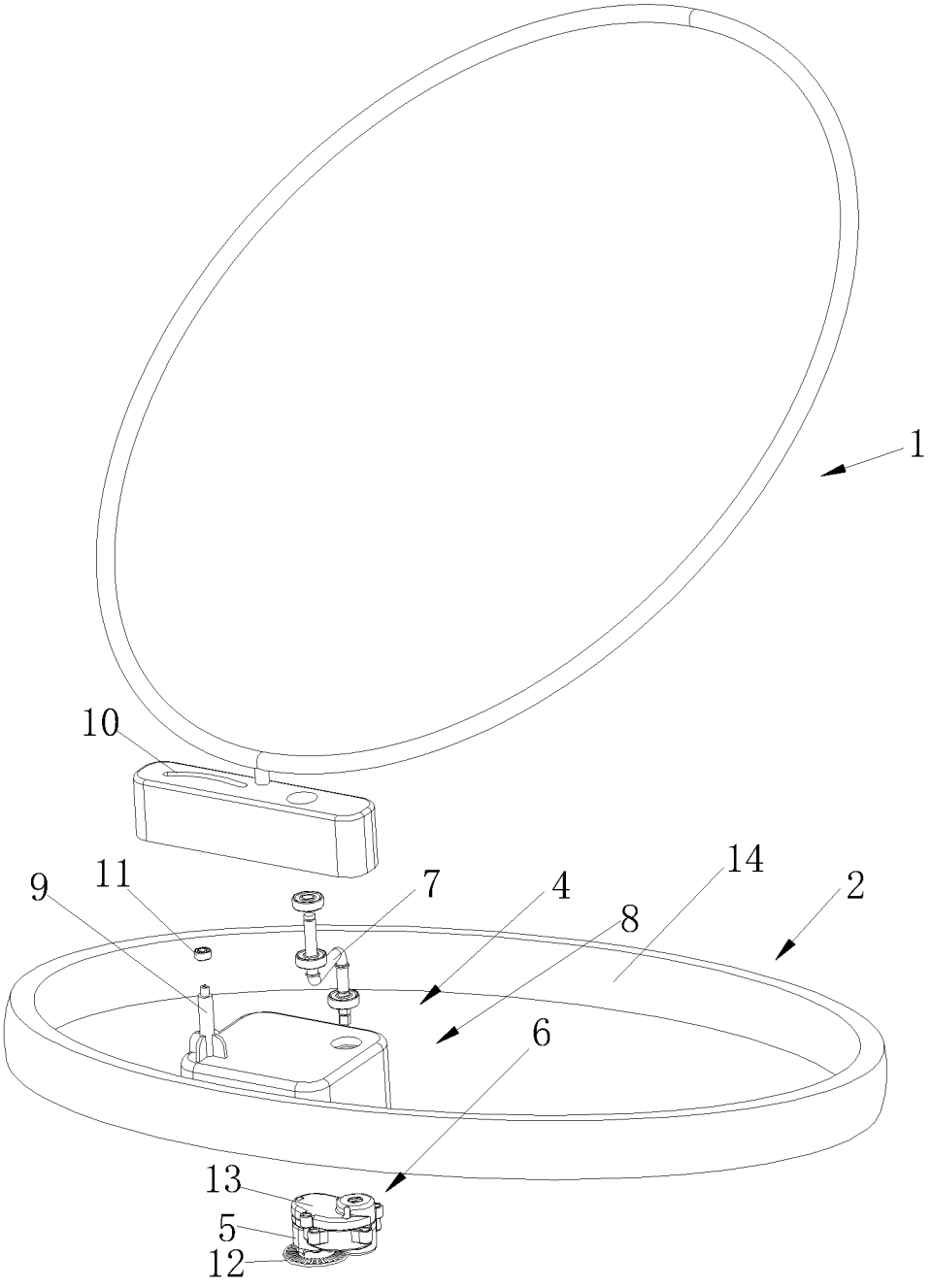
FIG. 4 is an exploded diagram of a rocking chair for children.
Figure 5:
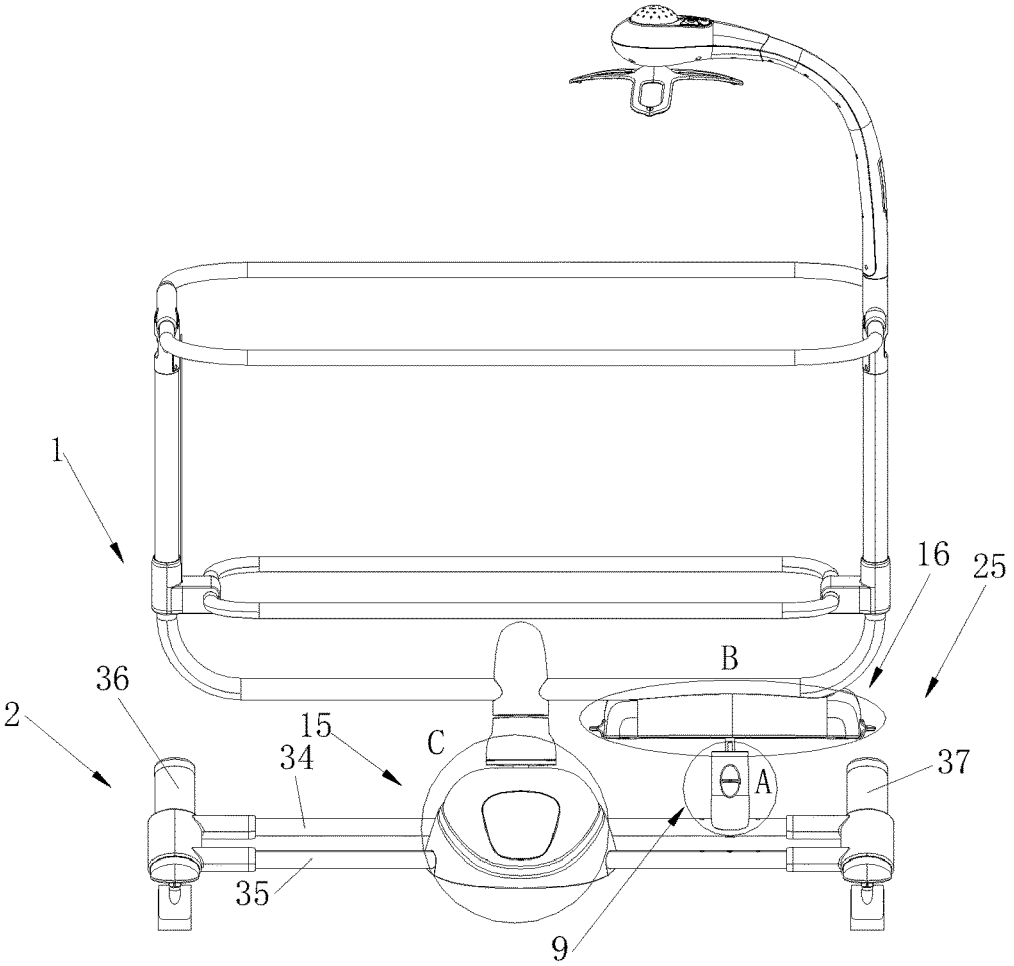
FIG. 5 is a structural diagram of a rocking chair for children.
Figure 6:
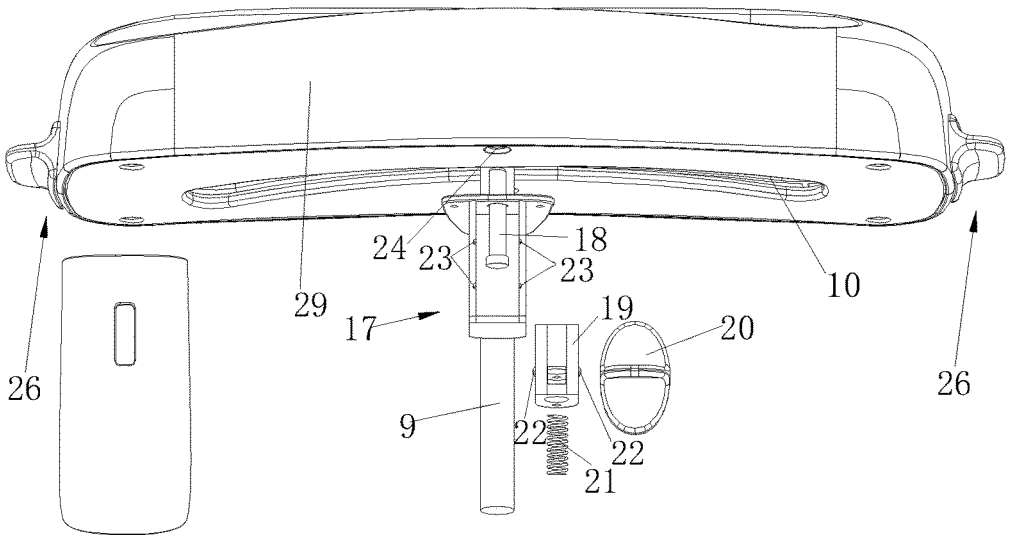
FIG. 6 is an exploded diagram of FIG. 5 at A.
Figure 7:
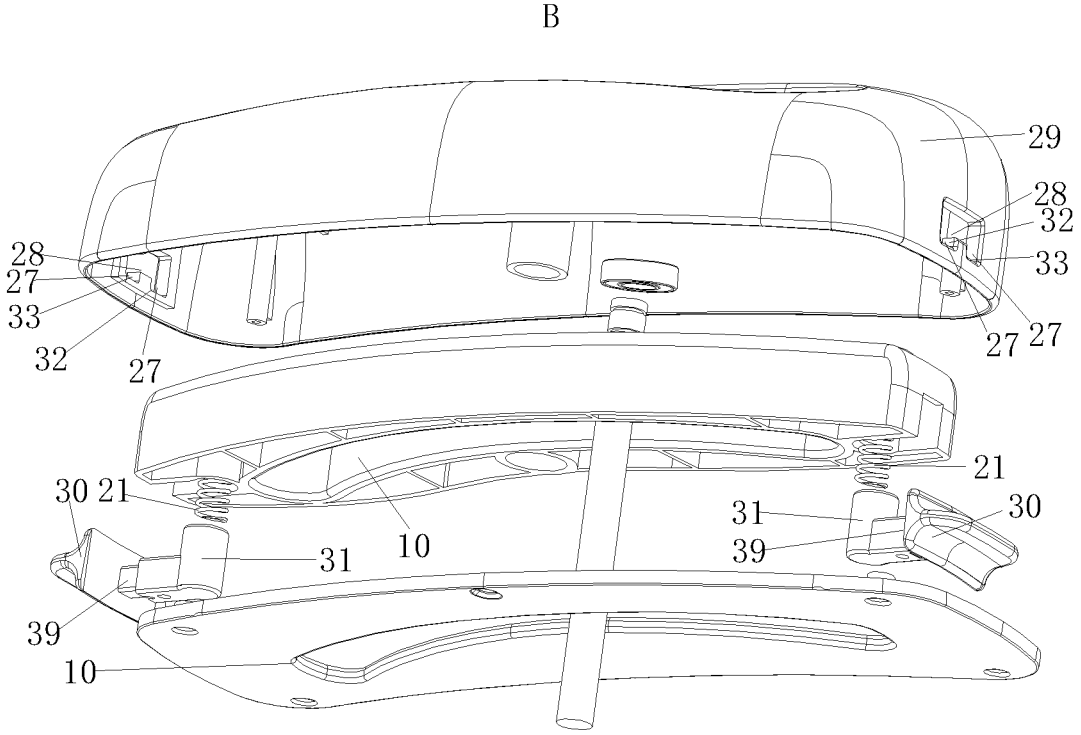
FIG. 7 is an exploded diagram of FIG. 5 at B.
Figure 8:
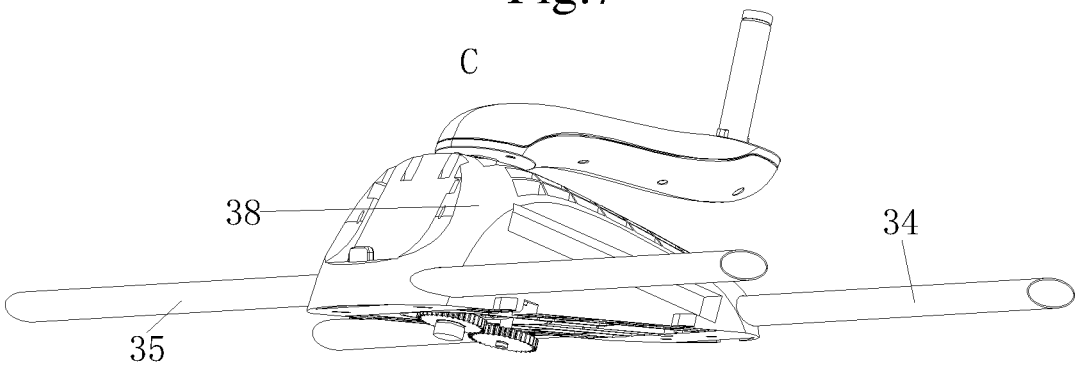
FIG. 8 is an internal structural diagram of FIG. 5 at C.

The embodiments of the present invention are now described with reference to the attached figures from 1 to 8.

The present invention provides a rocking chair for children, comprising a seat 1, a supporting frame 2 and a seat restricting mechanism 3, the supporting frame 2 comprising a base 14 and a driving mechanism 4, the driving mechanism 4 comprising a driving motor 5, a power-output part of the driving motor 6, a rotating shaft 7 and a mounting box 8; wherein the power-output part of the driving motor 6 is provided in the mounting box 8, an end of the rotating shaft 7 extends into the mounting box 8 and is fixedly connected to the power-output part of the driving motor 6, an opposite end of the rotating shaft 7 is pivoted with the seat 1, and a pivoting point of the opposite end of the rotating shaft 7 and the seat 1 moves at a certain distance relative to a fixed point of the end of the rotating shaft 7 and the power-output part of the driving motor 6 when the rotating shaft 7 rotates; the mounting box 8 being fixedly connected to the base 14, the seat restricting mechanism 3 enabling an angle between the seat 1 and the rotating shaft 7 to be maintained at a preset angle, when the driving motor 5 drives the rotating shaft 7 to rotate; the seat 1 being used to carry a child, the seat restricting mechanism 3 comprising a moving part 9 and a moving slot 10, the moving part 9 moving relative to the moving slot 10 when the rotating shaft 7 rotates.

By pivoting the seat 1 with the rotating shaft 7, the seat 1 does not rotate with the rotating shaft 7, whereas the seat 1 follows the rotating shaft 7 and moves relative to the supporting frame 2, which overcomes the situation that the seat 1 rotates relative to the rotating shaft 7. Providing the seat restricting mechanism 3 enables an angle between the seat 1 and the rotating shaft 7 to be maintained at a preset angle, when the driving motor 5 drives the rotating shaft 7 to rotate, which ensures both the stability of the seat 1 and the required preset angle.

The moving part 9 is provided on the supporting frame 2 or the seat 1, and the moving slot 10 matching with the moving part 9 is provided on the seat 1 or the supporting frame 2. When the moving part 9 is provided on the supporting frame 2, the moving slot 10 matching with the moving part 9 is provided on the seat 1; or the moving part 9 may be provided on the seat 1, while the moving slot 10 matching with the moving part 9 is provided on the supporting frame 2.

The moving slot 10 is an arc-shaped slot with a lower level in middle and higher levels on both sides or a wave-shaped slot with alternating high and low levels. The moving slot 10 may vary in shape. The shape of the moving slot is to determine the angle between the seat 1 and the rotating shaft 7, depending on the requirements, therefore a variety of shapes may be selected, such as the arc-shaped slot with the lower level in middle and higher levels on both sides. After the rotation of the rotating shaft 7, the seat 1 moves relative to the rotating shaft 7, and the angle between the seat body 1 and the rotating shaft 7 is still the same. Therefore, it is merely preferred that the moving slot 10 is an arc-shaped slot with a lower level in middle and higher levels on both sides or a wave-shaped slot with alternating high and low levels.

A rotating part 11 is provided on the moving part 9, the rotating part 11 may rotate around the moving part 9, and the rotating part 11 matches with a surface of the moving slot 10. Providing the rotating part 11 enables the reduction of friction when the moving part 9 moves relative to the moving slot 10. In the present embodiment, the rotating part 11 is a bearing.

The driving mechanism 4 further comprises a sensor 12 provided on the driving motor 5 and a reduction gearset 13 connected to the driving motor 5; the sensor 12 may control a continuous reciprocating forward and backward rotation of the driving motor 5, thereby enabling a continuous reciprocating forward and backward rotation of the rotating shaft 7. By detecting the rotation angle of the rotating shaft 7 and the rotation condition of the driving motor 5 through the sensor 12, the distance of the seat 1 to be moved may be controlled, and the speed may be reduced and the strength may be increased through the reduction gearset 13, which provides a simple structure and low cost. The rotating shaft 7, having a simple structure, is Z-shaped.

For the beauty of a swing bed, a driver mounting box 15 is provided thereon, and the driving motor 5, the power-output part of driving motor 6, and one end of the rotating shaft 7 are mounted in the driver mounting box 15. In order to lengthen the force arm so as to save effort and enable the swing bed to swing more smoothly, the moving slot 10 and the moving part 9 are provided away from the driver mounting box 15, while the moving slot 10 is provided on the seat 1 and the moving part 9 is provided on the base 14. Such a setup enables consumers not to see the slot hole of the moving slot 10 since the slot hole of the moving slot 10 is facing downward, thereby providing consumers with a more aesthetic appearance.

The mounting box 8 further comprises a moving-part mounting box 16, and a seat locking-and-unlocking part 17, used for locking or unlocking the seat 1 and the supporting frame 2, comprising a locking pin 18; a locking hole 24 matching with the locking pin 18; a sliding block 19; a driver switch 20, movably provided relative to the moving-part mounting box 16, the locking pin 18 being movably provided relative to the moving-part mounting box 16, the sliding block 19 being connected to the driver switch 20, the locking hole 24 being provided on the moving slot 10; and a reset spring 21. A convex point 22 is provided on the sliding block 19, and a concave point 23 matching with the convex point 22 is provided on the moving-part mounting box 16. A hole for mounting the reset spring 21 and the locking pin 18 is provided on the sliding block 19, when the locking pin 18 is required to match with the locking hole 24 on the moving slot 10, the driver switch 20 drives the sliding block 19 to move, the convex point 22 on the sliding block 19 is detached from the concave point 23 on the moving part 9, and the convex point 22 on the sliding block 19 is moved upward to match with the concave point 23 on the moving part 9 so that the locking pin 18 matches with the locking hole 24 on the moving slot 10 and the seat 1 is locked with the supporting frame 2. The seat locking-and-unlocking part 17 is provided between the moving slot 10 and the moving-part mounting box 16, and the advantage is that the seat locking-and-unlocking part 17 is away from the rotating shaft 7, thereby providing a long force arm, so as to stabilize the fixation of the seat 1. Therefore, the structure of the seat locking-and-unlocking part 17 is more solid and less prone to damage.

The seat restricting mechanism 3 comprises a swing mode switching part 25, the swing mode switching part 25 comprising the moving slot 10 and the moving part 9, the moving slot 10 being pivotally provided with the supporting frame 2; and a moving-slot locking-and-unlocking device 26, enabling the moving slot 10 to be in a locked position 27 and an unlocked position 28, the moving slot 10 being locked relative to the supporting frame 2 when the moving slot 10 is in the locked position 27, the moving slot 10 being rotatable relative to the supporting frame 2 when the moving slot 10 is in the unlocked position 28.

the mounting box 8 comprises a moving-slot mounting box 29, the moving slot 10 being pivotally connected to the moving-slot mounting box 29, the moving-slot mounting box 29 being fixedly connected to the supporting frame 2; the moving-slot locking-and-unlocking device 26 comprising a conversion switch 30; a lift-down part 31; the conversion switch 30 extending into the moving-slot mounting box 29 to be fixedly connected to the lift-down part 31, and a moving-guiding slot being provided on the moving slot 10 for the lift-down part 31 to be lifted or lowered; a reset spring 21, a hole for mounting the reset spring 21 being provided on the lift-down part 31, the reset spring 21 being provided between the mounting box 8 and the lift-down part 31; a moving-part locking pin 39, provided on the conversion switch 30; and at least a first locking hole 32 and a second locking hole 33, provided on the mounting box 8. When the conversion switch 30 is lifted upward from the first locking hole 32 to the unlocked position 28, the conversion switch 30 drives the moving slot 10 to rotate relative to the moving-slot mounting box 29 and drop down into the second locking hole 33, and the moving slot 10 is locked with the moving-slot mounting box 29, thereby converting the swing mode from one to another, so as to realize the conversion of the swing mode and enrich the entertainment demand of consumers. Additionally, such a simple structure to realize the conversion of the swing mode provides a simple operation and is at a low cost.

The base 14 comprises a first connecting tube 34, a second connecting tube 35, a first leg tube 36, and a second leg tube 37; wherein the first leg tube 36 and the second leg tube 37 are detachably connected to the first connecting tube 34 and the second connecting tube 35 respectively, the driver mounting box 15 comprises a driver mounting part 38 fixedly connected to the first connecting tube 34 and the second connecting tube 35. The aforementioned structure not only overcomes the disadvantage of an easy tilt of the connecting tube but also realizes the advantage that the leg tube and the connecting tube may be disassembled in order to achieve a product small in size, thereby reducing the cost.

Although the invention has been described above with reference to embodiments, it is possible to perform various improvements and other ways to implement the invention that are equivalent or well-known to those skilled in the art, without departing from the scope of the invention. In particular, the features in the disclosed embodiments of the present invention may be combined in any manner, as long as there is no structural conflict, and these combinations are not described exhaustively in the present specification simply due to considerations of omitting space and saving resources. Thus, the invention is not limited to the particular embodiments disclosed in the text but comprises all technical solutions that fall within the scope of the claims. The terms "first" and "second" described herein are only for the purpose of distinguishing names of objects, which have no particular and actual data meanings.

The present invention provides a rocking chair for children, the swinging amplitude being great, the cost of the rocking chair being low, the seat being stable, the structure being simple, and the rocking chair being able to be set to two or more different swing mode; which overcomes the shortcomings of rocking chairs on the current market, whose swinging amplitude is small, whose process requirements are complicated, and which is merely able to swing in single mode. The structure of the present invention is simple and cost-saving, and the seat of the chair is stable, which is invented after long and careful research by engineers, not easily thought of by a person in the art, and not part of public common knowledge.

The invention claimed is:

1. A rocking chair for children, characterized in that, comprising a seat, a supporting frame and a seat restricting mechanism, the supporting frame comprising a base, and a driving mechanism, the driving mechanism comprising a driving motor, a power-output part of the driving motor, a rotating shaft, and a mounting box;

wherein an end of the rotating shaft is fixedly connected to the power-output part of the driving motor, an opposite end of the rotating shaft is pivoted with the seat, and a pivoting point where the opposite end of the rotating shaft pivoted with the seat moves at a certain distance relative to a fixed point where the end of the rotating shaft fixed with the power-output part of the driving motor when the rotating shaft rotates;

the driving motor and the power-output part of the driving motor being provided on the mounting box, the mounting box being fixedly connected to the base, the seat restricting mechanism enabling an angle between the seat and the rotating shaft to be maintained at a preset angle when the driving motor drives the rotating shaft to rotate; and the seat being used to carry a child, the seat restricting mechanism comprising a moving part and a moving slot matching with the moving part, the moving part moving relative to the moving slot when the rotating shaft rotates.

2. The rocking chair for children according to claim 1, characterized in that, wherein the moving part is provided on the supporting frame or the seat, and the moving slot matching with the moving part is provided on the seat or the supporting frame.

3. The rocking chair for children according to claim 2, characterized in that, wherein the moving slot is an arc-shaped slot with a lower level in middle and higher levels on both sides.

4. The rocking chair for children according to claim 3, characterized in that, wherein a rotating part is provided on the moving part, the moving part being able to rotate around the moving part, the moving part matching with a surface of the moving slot.

5. The rocking chair for children according to claim 4, characterized in that, wherein the driving mechanism further comprises:

a sensor provided on the driving motor, and a reduction gearset connected to the driving motor;

the sensor controls a continuous reciprocating forward and backward rotation of the driving motor, thereby enabling a continuous reciprocating forward and backward rotation of the rotating shaft, the rotating shaft being Z-shaped.

6. The rocking chair for children according to claim 5, characterized in that, wherein the mounting box comprises:

a driver mounting box, configured to mount the driving motor, a power-output part of the driving motor, and a rotating shaft;

the driver mounting box is provided on the base, the moving slot being provided on the seat away from the driver mounting box, and the moving part being provided on the base away from the driver mounting box.

7. The rocking chair for children according to claim 6, characterized in that, wherein the mounting box further comprises:

a moving-part mounting box, and a seat locking-and-unlocking part, used for locking or unlocking the seat and the supporting frame, comprising:

a locking pin;

a locking hole matching the locking pin;

a sliding block;

a driver switch, movably provided relative to the moving-part mounting box, the locking pin being movably provided relative to the moving-part mounting box, the sliding block being connected to the driver switch, the locking hole being provided on the moving slot; and a reset spring.

8. The rocking chair for children according to claim 6, characterized in that, wherein the base comprises:

a first connecting tube, a second connecting tube, a first leg tube, and a second leg tube;

the first leg tube and the second leg tube are detachably connected to the first connecting tube and the second connecting tube respectively, the driver mounting box comprising a driver mounting part fixedly connected to the first connecting tube and the second connecting tube.

9. The rocking chair for children according to claim 1, characterized in that, wherein the seat restricting mechanism comprises:

a swing mode switching part, comprising the moving slot and the moving part, the moving slot being pivotally provided with the supporting frame; and a moving-slot locking-and-unlocking device, enabling the moving slot to be in a locked position and an unlocked position, the moving slot being locked relative to the supporting frame when the moving slot is in the locked position, the moving slot being rotatable relative to the supporting frame when the moving slot is in the unlocked position.

10. The rocking chair for children according to claim 9, characterized in that, wherein the mounting box comprises:

a moving-slot mounting box, the moving slot being pivotally connected to the moving-slot mounting box, the moving-slot mounting box being fixedly connected to the supporting frame; the moving-slot locking-and-unlocking device comprising:

a conversion switch;

a lift-down part;

the conversion switch extending into the moving-slot mounting box to be fixedly connected to the lift-down part, a moving-guiding slot being provided on the moving slot for the lift-down part to be lifted or lowered;

a reset spring, a hole for mounting the reset spring being provided on the lift-down part, the reset spring being provided between the mounting box and the lift-down part;

a moving-part locking pin, provided on the conversion switch; and at least a first locking hole and a second locking hole, provided on the mounting box.

* * * * *